United States Patent [19]

Beyer et al.

[11] Patent Number: 4,918,410

[45] Date of Patent: Apr. 17, 1990

[54] ISOLATOR FOR MICROWAVE ELECTROMAGNETIC RADIATION

[75] Inventors: Adalbert Beyer, Straelen; Ingo Wolff, Aachen, both of Fed. Rep. of Germany

[73] Assignee: Britist Telecommunications, Public Limited Company, London, United Kingdom

[21] Appl. No.: 731,518

[22] Filed: May 7, 1985

[30] Foreign Application Priority Data

May 9, 1984 [GB] United Kingdom ..... 8411792

[51] Int. Cl.[4] ..... H01P 1/37

[52] U.S. Cl. ..... 333/24.2; 333/81 B

[58] Field of Search ..... 333/24.2, 81 A, 81 B

[56] References Cited

U.S. PATENT DOCUMENTS

| | | | |
|---|---|---|---|
| 2,922,964 | 1/1960 | Turner | 333/24.2 |
| 2,958,055 | 10/1960 | Rowen | 333/24.2 X |
| 3,316,508 | 4/1967 | Jones . | |
| 3,327,251 | 6/1967 | Degan . | |

OTHER PUBLICATIONS

*Foam Plastics Handle a Wide Range of Jobs,* Electronics, Oct. 1956, pp. 196–199.

Metcalf, *Cellular Insulation As An Answer to Material Conservation,* Proc. of 13th 23rd Int'l. Wire & Cable Symposium, Dec. 3–5, 1974, pp. 53–58.

Beyer et al., *A New Fin-Line Ferrite Isolator for Integrated Millimeter-Wave Circuits,* IEEE Trans. on MTT, Dec. 1981, pp. 1344–1348.

A Fin Line Ferrite Isolator and Circulator For the R-Band (Paper for 11th European Microwave Conference, Amsterdam, 7–10 Sep. 81).

"A New Form of Ferrite Device for Millimeter-Wave Integrated Circuits", Ved P. Nanda, IEEE Trans. on Microwave Theory & Techniques, vol. MTT-24, No. 11 (1976).

*Primary Examiner*—Paul Gensler

*Attorney, Agent, or Firm*—Nixon & Vanderhye

[57] ABSTRACT

An insert for non-reciprocal waveguide device comprises a layer of ferrite and a layer of energy absorbing material with a spacer layer between them. The device works by reason of asymmetrical interaction of the microwave energy and the ferrite whereby energy is preferentially absorbed in the reverse direction. The spacer layer affects the distribution of electromagnetic fields so that there is a relatively low attenuation associated with one direction and a relatively high attenuation associated with the reverse direction.

27 Claims, 1 Drawing Sheet

FIG. 1
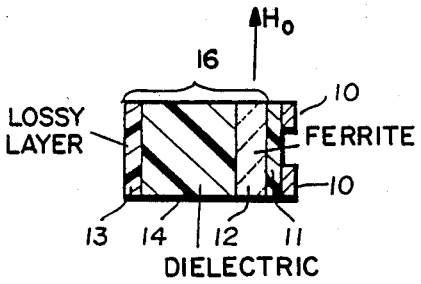
FIG. 2
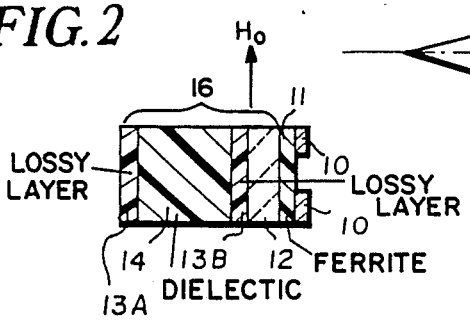
FIG. 3
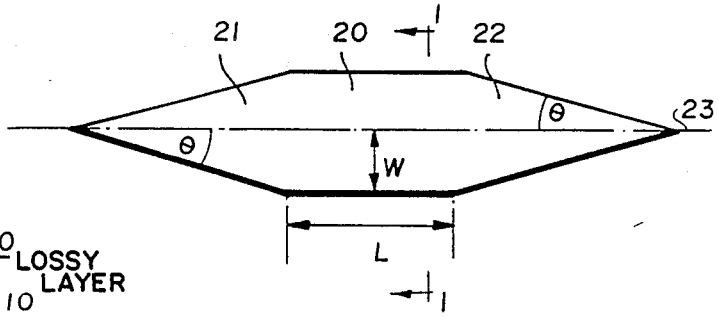
FIG. 4
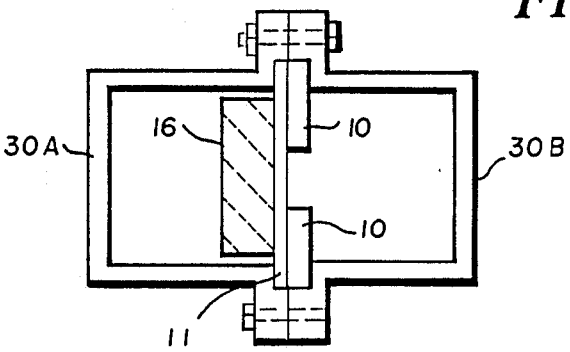
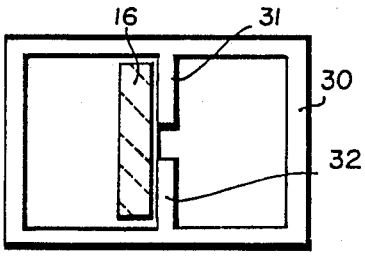
FIG. 5

ISOLATOR FOR MICROWAVE ELECTROMAGNETIC RADIATION

This invention relates to non-reciprocal devices which provide a pathway for microwave energy. More particularly it relates to devices, especially finline and waveguide structures, which are adapted to provide good isolation, i.e. a relatively low attenuation in one direction and a relatively high attenuation in the reverse direction.

Finline structures having this property are described in:

(a) Proceedings of the 11th European Microwave Conference, Amsterdam, 7–10 September 1981, pages 321–326.

(b) IEEE Transactions, MTT-29 No. 12. December 1981 pages 1344–1348.

The prior art structures comprise a lamella structure in contact with the dielectric substrate of the finline. The structures may include layers of ferrite, dielectric and lossy material arranged in particular orders. It has now been discovered that the particular choice of materials and arrangements of the layers enhances the performance of the device, i.e. both a good isolation and a low forward insertion loss.

According to this invention a lamella structure, suitable for use in non-reciprocal devices, includes a ferrite layer and an energy absorbing layer characterised in that a dielectric spacer layer is situated between them. Preferably the lamella structure includes an extra energy absorbing layer situated between the ferrite layer and the spacer layer.

A lamella structure with particularly good properties has four layers, namely a spacer layer situated between and in contact with two energy absorbing layers and having the ferrite layer in contact with one of the energy absorbing layers.

The lamella structures described above may be used in conjunction with the finline devices, e.g. unilateral, bilateral, antipodal and insulated structures. The lamella structure may also be used inside waveguides including ridged waveguides.

In order to provide optimum magnetic field strength for the lamella structure to suit the frequency of operation a magnet may be incorporated. The magnetic field $H_o$ may be conventionally oriented as shown in FIGS. 1 and 2 and in my above-referenced 1981 IEEE publication.

As will be more precisely defined in the claims, the invention includes, in addition to the lamella structures per se, finline devices and waveguide devices which incorporate the lamella structures.

The invention will now be described by way of example with reference to the accompanying drawings in which:

FIGS. 1 and 2 are transverse cross sections illustrating lamella structures according to the invention.

FIG. 3 is an elevated side view for the structures of FIG. 2 (the cross-sectional views of FIGS. 1 and 2 being taken along the line 1 shown in FIG. 3), FIG. 4 shows a finline/lamella structure in a waveguide, and FIG. 5 shows a lamella structure in a ridged waveguide.

As explained above the invention is characterized by the selection of the materials forming the layers as well as the arrangement of the layers. The materials used will be discussed first.

The invention may be implemented in conjunction with finline devices in which the path is provided by one or more conductive, e.g. copper, layers supported by one or more substrate layers formed of a low loss dielectric, e.g. a fluorocarbon polymer. For convenience the drawings will show a single conductive layer, designated by the numeral 10 in each Figure, and a single substrate, designated by the numeral 11 in each Figure.

The lamella structure of the invention includes a ferrite layer, designated 12 in each Figure. The lamella structure also includes a lossy (i.e. energy absorbing) layer or layers, designated 13, and a spacer layer, designated 14.

The lossy layer may be:

(a) dielectric material with a dielectric loss factor characterized by a tan (delta) in excess of 0.01, (b) a material with a magnetic loss factor characterised by a tan (delta-m) in excess of 0.01, e.g. magnetically loaded epoxy resins (such as are available under the commercial name "ECCOSORB CR 124")

(c) a resistive material having a sheet resistance in the range 10 to 3000, e.g. 50 to 500, ohms per square. The lossy layer may be formed of a plurality of resistive layers wherein an individual layer may have a sheet resistance above the range specified provided that the composite resistance is within the range specified.

It will be appreciated that any given material may display two or three of the properties given above; it is suitable if any one property lies within the range specified.

The spacer layer (14) is a dielectric with a loss angle less than that of the lossy material. Its dielectric constant is preferably in the range 1.5 to 20. Suitable materials include glass microfibre reinforced polytetrafluoroethylene (such as the material available under the commercial name "RT/DUROID 5880") and epoxy casting resins (such as the material available under the commercial name "ECCOSORB CR 110").

Without being bound by any theory, it is believed that the devices according to the invention work by reason of asymmetrical interaction between fields associated with the microwave energy and the ferrite, and by reason of dissipation in the energy absorbing layer or layers. It is believed that the spacer layer affects the distribution of the electromagnetic fields in such a way that the non-reciprocal effect is enhanced.

FIG. 1 shows a conventional finline structure comprising a conductive layer 10 supported on a substrate 11. To provide non-reciprocal properties the substrate 11 is in contact with the ferrite layer 12 of a lamella structure according to the invention. The lamella structure includes, as well as the ferrite layer 12, a lossy layer 13 separated from the ferrite layer by a spacer layer 14.

A modification having an even better performance than the embodiment of FIG. 1 is shown in FIG. 2. This modification includes two lossy layers 13A and 13B in contact with the spacer layer 14. The ferrite layer 12 is in contact with lossy layer 13B and also in contact with the substrate 11 of finline structure having conductive layer 10 to provide a path for microwave energy.

The drawings show the functional layers and it should be understood that it may be mechanically convenient to implement a single layer by juxtaposing a plurality of similar layers. Thus, where a low resistance layer is required, it may be difficult to obtain a single layer with a sufficiently low sheet resistance. In this case the desired sheet resistance could be achieved by several layers of higher sheet resistance.

In FIGS. 1 and 2, layers 10 and 11 constitute the finline and remaining layers the lamella structure according to the invention. The lamella structure has uniform thickness and the layers are uniform across the thickness, i.e. as shown in FIGS. 1 and 2. As shown in FIG. 3, the side configuration is a rectangular centre section 20 with tapered ends 21 and 22. The drawings show centre line 23 (not part of the device) and the device is, in its side dimensions, symmetrical about this centre line. The taper has an angle $\theta$ as marked; $\theta$ is most suitably in the range 10° to 15° but both sharper and more gradual tapers are acceptable. The width (dimension W of FIG. 3 shows the half width) is chosen to conform to the waveguide in which it will be used and the length (L of FIG. 3) is chosen, to give sufficient reverse isolation without incurring unacceptably high forward loss.

FIG. 4 shows a finline implementation mounted in a waveguide comprising halves 30A and 30B which can be separated to accept inserts. In this case the inserts comprise a finline structure with conductive layer 10 and substrate 11, gripped between the two halves of the waveguide, and a lamella structure 16 according to the invention which structure is adjacent to the finline.

FIG. 5 shows a similar implementation in ridged waveguide having a body 30 with ridges 31 and 32. In accordance with the invention the waveguide contains a lamella structure 16 according to the invention including a ferrite layer 12 in contact with the ridges 31 and 32.

Telecommunications practice uses microwave radio links which operate in a band which has nominal frequency of 29 GHz and experiments related to this band were carried out. Three lamella structures according to the invention, hereinafter identified as E1, E2 and E3, were mounted in wave guides and performance measurements were made on the wave guides.

Comparative measurements were also made on a prior art structure hereinafter identified as PA. (Structure PA correspond to the teaching of IEEE "Transactions on Microwave Theory and Techniques" Vol MTT-29 No. 12 for December 1981 at pages 1344 to 1348 "a New Fin-Line Ferrite Isolator for Integrated Millimeter-Wave Circuits.") Structure E1 corresponds to FIG. 1 of the drawings herein the energy absorbing layer, i.e. layer 13, was provided as a lossy dielectric having a loss angle greater than 0.1 radians.

Structures E2 and E3 both correspond to FIG. 2 of the drawings wherein the energy absorbing layers, i.e. layers 13A and 13B, were provided as resistive layers. The resistances of these layers, in ohms per square, are given in table 1.

TABLE 1

| Structure | E2 | E3 |
|---|---|---|
| Resistance of layer 13 A | 300 | 300 |
| Resistance of layer 13 B | 300 | 100 |

Structure PA was used as a basis for comparision and it also corresponded to FIG. 1 of the drawings but layers 12 and 14 were interchanged so that the ferrite was adjacent to the energy absorbing layer. In the case of structure PA the energy absorbing layer was provided as a composite of the same lossy material as E1 and a resistive layer with a resistance of 150 ohms per square.

In the case of structures PA, E1 and E2 the spacer layer was made from Duroid 5880 (dielectric constant about 2.2) and for structure E3 the spacer layer was Eccosorb CR110 (dielectric constant about 2.7). These materials have similar properties and both have a low loss. The ferrite layer and the spacer layer had the same properties in all cases.

For test purposes, the structures E1, E2, E3 and PA were all mounted in a wave guide as shown in FIG. 4. The desirable properties of an isolator are as follows:

(a) Attenuation in the forward direction should be as low as possible;

(b) Attenuation in the reverse direction should be as high as possible;

(c) Adequate isolation effect should extend over as wide a frequency band as possible.

Properties (a) and (b) can be regarded as defining an isolator. Property (c) is relevant because the performance of an isolator is frequency dependent. It is relatively simple to make an isolator which has good properties over only a narrow or monochromatic band but such isolators may display only a poor performance when used in applications where different frequencies are encountered, either simultaneously or sequentially.

In addition to the basic features identified above the difference, (b)−(a), between forward and reverse attenuation is also a relevant parameter. This difference is particulrly relevant when the isolator is utilized to attenuate reflected radiation. In these circumstances the small but unavoidable forward attenuation can be compensated by an increase of power which results in an equivalent increase in the power of the reflected radiation. In other words the full potential of the reverse attenuation is not achieved and the short-fall may be attributed to the forward attenuation. Thus the difference constitutes a useful parameter to assess the overall performance.

Performance parameters related to the 29 GHz telecommunications band are given below in Table 2. The parameters were obtained by measuring forward and reverse attenuations of wave guides containing structures E1, E2, E3 and PA. The measurements were made over the whole of the frequency band 27.5 to 29.5 GHz (extending slightly above and below to ensure information about the whole of the band) and the "worst values" of attenuations within the whole band were selected. The minimum reverse attenuation is given in the column headed "R" of Table 2 and the maximum forward attenuation is given in the column headed "F". The difference between them is given in the column headed "R-F". (All these figures are in dB).

In addition the bandwidth, in GHz, of acceptable performance is given in the column headed "W". The criterion of acceptable performance required both "good" reverse attenuation, i.e. above 30 dB, and "good" forward attenuation, i.e. below 2 dB.

TABLE 2

| DEVICE | R | F | R-F | W |
|---|---|---|---|---|
| PA | 17 | 4.5 | 12.5 | 0.4 |
| E1 | 27 | 2.8 | 24.2 | 0.6 |
| E2 | 35 | 2.9 | 32.1 | 1.8 |
| E3 | 37 | 1.2 | 35.8 | 3+ |

(Note 3+ means more than 3 GHz)

Structure E1, which places the spacer layer between the ferrite layer and the absorber layer in accordance with the invention, exhibits a substantially better potential in respect of reverse and forward attenuations although the bandwidth given in column "W" is only a little better, i.e. about 30°/o of bandwidth of interest.

Structures E2 and E3, which represent a preferred embodiment with an extra absorbent layer between the ferrite layer and the spacer layer, exhibit a substantial increase in the bandwidth of satisfactory performance; this advantageous property is reflected in the good attenuation results given in the other columns.

Structure E3 gives an outstanding performance for a simple structure compatible with planar circuits. The bandwidth of satisfactory performance, i.e. 3 GHz in column "W", exceeds the 2 GHz width for the band of interest, i.e. 27.5 to 29.5 GHz. The high reverse attenuation, 37 in column "R", and the low forward attenuation, i.e. 1.2 in column "F", emphasize the good performance of this device.

We claim:

1. A non-reciprocal E-plane device comprising:

waveguide means, adapted to receive microwave signals, for propagating microwave signals therethrough; and a lamella structure disposed in said waveguide means, said structure including a ferrite layer adapted to be disposed in a magnetic field, a microwave energy absorbing layer, and a dielectric spacer layer disposed between the energy absorbing layer and the ferrite layer, said layers being oriented parallel to the E-plane of said waveguide means and said dielectric layer having a dielectric constant of at least 1.5, said structure attenuating signals propagating through said waveguide means in a first direction by a first attenuation and attenuating signals propagating through said waveguide means in a second direction opposite said first direction by a second attenuation much greater than said first attenuation.

2. An E-plane device according to claim 1 further including magnetic means for providing a magnetic field parallel to said E-plane and in the vicinity of the lamella structure.

3. A non-reciprocal E-plane device comprising:

waveguide means, adapted to receive microwave signals, for propagating microwave signals therethrough; and a lamella structure disposed in said waveguide means, said structure including a ferrite layer adapted to be disposed in a magnetic field, a microwave energy absorbing layer, and a dielectric spacer layer disposed between the energy absorbing layer and the ferrite layer, said layers being oriented parallel to the E-plane of said waveguide means and said dielectric layer having a dielectric constant of at least 1.5, said structure attenuating signals propagating through said waveguide means in a first direction by a first attenuation and attenuating signals propagating through said waveguide means in a second direction opposite said first direction by a second attenuation much greater than said first attenuation;

wherein the lamella structure additionally includes a further microwave energy absorbing layer disposed between the dielectric spacer layer and the ferrite layer.

4. A lamella structure comprising a ferrite layer, a microwave energy absorbing layer, and a dielectric spacer layer situated between the ferrite layer and the energy absorbing layer, said spacer layer having a dielectric constant between 1.5 and 20 and said layers being adapted for orientation parallel to a magnetic field and the E-field of propagating microwave energy so as to effect non-reciprocal propagation thereof.

5. A lamella structure according to claim 4, in which the energy absorbing layer is a resistive layer.

6. A lamella structure according to claim 5, wherein the sheet resistivity of said energy absorbing layer is in the range 10 to 3000 ohms per square.

7. A lamella structure according to claim 4, in which the energy absorbing layer is a dielectric layer with a loss angle exceeding 0.01 radians.

8. A lamella structure as in claim 4 wherein:

said layers are adapted to be disposed in a waveguide propagating microwave radiation therethrough; and said layers are each oriented in the E-plane of said microwave radiation propagating through said waveguide.

9. A lamella structure comprising:

a ferrite layer, a microwave energy absorbing layer, a dielectric spacer layer situated between the ferrite layer and the energy absorbing layer;

said spacer layer having a dielectric constant between 1.5 and 20 and said layers being adapted for orientation parallel to a magnetic field and the E-field of propagating microwave energy so as to effect non-reciprocal propagation thereof; and an additional microwave energy absorbing layer situated between the ferrite layer and the dielectric spacer layer.

10. A non-reciprocal finline device comprising:

a finline including at least one conductive layer adapted to define a conductive transmission line path for microwave energy propagation therealong, said conductive layer being supported on at least one substrate layer; and a lamella structure adapted to be disposed in a magnetic field and disposed adjacent to said finline, said lamella structure comprising:

a ferrite layer adjacent to said finline;

a microwave energy absorbing layer and a dielectric layer having a dielectric constant of at least 1.5 disposed between the energy absorbing layer and the ferrite layer, said layers being oriented parallel to the E-plane of microwave energy when propagated along said path.

11. A finline device according to claim 10, wherein the ferrite layer of the lamella structure is adjacent to said substrate layer of the finline.

12. Apparatus comprising:

means for defining a microwave signal propagation path along which microwave energy may be propagated with a predetermined E-field orientation; and isolator means, disposed along said path and adapted to be disposed in a magnetic field, for providing high attenuation of microwave signals propagating along said path in a first direction and for providing low attenuation of microwave signals propagating along said path in a second direction opposite said first direction, said isolator means including a laminated structure having a ferrite layer, a microwave energy absorbing layer, and a dielectric spacer layer having a dielectric constant of at least 1.5, said layers arranged in a laminated stack with said dielectric spacer layer separating said ferrite layer and said energy absorbing layer, each of said layers being oriented parallel to said E-plane.

13. Apparatus as in claim 12 wherein said laminated structure is uniform in thickness, and said layers are each uniform in thickness.

14. Apparatus as in claim 13 wherein said laminated structure is tapered at at least one end with an angle in the range of 10 to 15 degrees.

15. Apparatus as in claim 12 wherein said spacer layer has a dielectric constant in the range of 1.5 to 20.

16. Apparatus as in claim 12 wherein said spacer absorbing layer comprises a lossy dielectric having a loss angle of at least 0.1 radius.

17. Apparatus as in claim 12 wheren said energy absorbing layer comprises a resistive layer with a resistance in the range of 50 to 500 ohms per square.

18. Apparatus as in claim 12 wherein said energy absorbing layer comprises a plurality of resistive layers.

19. Apparatus as in claim 12 wherein said ferrite layer is magnetized.

20. Apparatus as in claim 12 further including means for applying a magnetic field to said ferrite layer.

21. Apparatus as in claim 12 wherein said ferrite layer and said spacer layer are disposed in direct contact with one another.

22. Apparatus as in claim 21 wherein said energy absorbing layer and said spacer layer are disposed in direct contact with one another.

23. Apparatus comprising:

means for defining a microwave signal propagation path along which microwave energy may be propagated with a predetermined E-field orientation; and isolator means, disposed along said path and adapted to be disposed in a magnetic field, for providing high attenuation of microwave signals propagating along said path in a first direction and for providing low attenuation of microwave signals propagating along said path in a second direction opposite said first direction, said isolator means including a laminated structure having a ferrite layer, a microwave energy absorbing layer, and a dielectric spacer layer having a dielectric constant of at least 1.5, said layers arranged in a laminated stack with said dielectric spacer layer separating said ferrite layer and said energy absorbing layer, each of said layers being oriented parallel to said E-plane;

wherein said energy absorbing layer comprises a magnetically loaded epoxy resin mateial with a magnetic loss factor in excess of 0.01.

24. Apparatus comprising:

means for defining a microwave signal propagation path along which microwave energy may be propagated with a predetermined E-field orientation; and isolator means, disposed along said path and adapted to be disposed in a magnetic field, for providing high attenuation of microwave signals propagating along said path in a first direction and for providing low attenuation of microwave signals propagating along said path in a second direction opposite said first direction, said isolator means including a laminated structure having a ferrite layer, a microwave energy absorbing layer, and a dielectric spacer layer having a dielectric constant of at least 1.5, said layers arranged in a laminated stack with said dielectric spacer layer separating said ferrite layer and said energy absorbing layer, each of said layers being oriented parallel to said E-plane;

wherein said energy absorbing layer comprises a dielectric material with a dielectric loss factor characterized by a tan ($\Delta$) in excess of 0.01.

25. Apparatus comprising:

means for defining a microwave signal propagation path along which microwave energy may be propagated with a predetermined E-field orientation; and isolator means, disposed along said path and adapted to be disposed in a magnetic field, for providing high attenuation of microwave signals propagating along said path in a first direction and for providing low attenuation of microwave signals propagating along said path in a second direction opposite said first direction, said isolator means including a laminated structure having a ferrite layer, a microwave energy absorbing layer, and a dielectric spacer layer having a dielectric constant of at least 1.5, said layers arranged in a laminated stack with said dielectric spacer layer separating said ferrite layer and said energy absorbing layer, each of said layers being oriented parallel to said E-plane;

wherein said laminated structure further comprises a further energy absorbing layer disposed in said stack between said ferrite layer and said spacer layer.

26. Apparatus as in claim 25 wherein said further energy absorbing layer is disposed in direct contact with said ferrite layer and said spacer layer.

27. Apparatus as in claim 26 wherein said spacer layer is disposed in direct contact with said first-mentioned and further energy absorbing layers.

* * * * *